US005836388A

United States Patent [19]

Tchakarov

[11] Patent Number: 5,836,388

[45] Date of Patent: Nov. 17, 1998

[54] FLEXIBLE JOINT FOR DOWNHOLE TOOLS

[75] Inventor: Borislav J. Tchakarov, Houston, Tex.

[73] Assignee: Computalog Limited, Calgary, Canada

[21] Appl. No.: 893,330

[22] Filed: Jul. 16, 1997

[51] Int. Cl.[6] ..... E21B 17/20

[52] U.S. Cl. ..... 166/242.6; 175/73

[58] Field of Search ..... 166/50, 117.5, 166/242.1, 242.6; 175/61, 62, 73

[56] References Cited

U.S. PATENT DOCUMENTS 3,920,076 11/1975 Laky ..... 166/84.4 X
5,769,558 6/1998 Jekielek ..... 175/73 X

*Primary Examiner*—Roger Schoeppel
*Attorney, Agent, or Firm*—James E. Bradley; Andrew J. Dillon

[57] ABSTRACT

A downhole measurement tool is lowered into a well through a drill pipe. The tool has at least two modules which are joined by a flexible linkage. The linkage has two subs, each of which has an electrical connector for the modules. Each sub has a hub that is threaded. A threaded retainer nut retains each connector. Each nut has a hub that is threaded and is smaller in diameter than the sub hub. A coiled inner spring threadingly engages each nut hub. A coiled outer spring surrounds and threadingly engages each sub hub. The outer spring surrounds the inner spring and is wound in an opposite direction of the inner spring. The springs are embedded within an elastomeric member. The inner spring is dimensioned such that, for a selected lateral bend prior to installation with the outer spring, the inner spring will twist a selected angle in a first twist direction. Similarly, the outer spring is dimensioned such that for the selected lateral bend, prior to installation with the inner spring, the outer spring will twist substantially the same as the selected angle, but in a direction opposite to the first twist direction so as to cancel any twist between the subs once installed and subjected to a lateral bend. When the tool encounters a curved portion of the well, the inner spring, outer spring and elastomeric member flex to improve the navigability of the tool through the curved portion.

15 Claims, 2 Drawing Sheets

FLEXIBLE JOINT FOR DOWNHOLE TOOLS

TECHNICAL FIELD

This invention relates in general to downhole tools and in particular to a flexible joint for downhole measurement tools.

BACKGROUND ART

Generally, downhole tools are lowered through the inner diameter of drill pipe or tubing for various purposes. Some tools are provided with power through electrical conductors while other tools are battery-powered. Downhole tools may comprise a number of modules with lengths up to thirty feet. Some examples of longer tools include steering or guiding tools which are particularly used in horizontal wells. Measurement While Drilling Systems (MWD) or steering tools require some flexibility when passing through curved portions of wells that have a short or medium radius of build. If the bending stresses are severe, the modules may be damaged mechanically. One prior art device utilizes a knuckle joint linkage with moving, metal-to-metal parts which are exposed to the high pressure and high temperature corrosive and abrasive downhole environment. The corrosive environment and the vibrations encountered in normal drilling operations can decrease the reliability and life of the linkage.

DISCLOSURE OF INVENTION

A downhole measurement tool is lowered into a well through a drill pipe. The tool comprises two modules which are joined by a flexible linkage. The linkage has two subs, each of which has an electrical connector for the modules. Each sub has a hub that is threaded. A threaded retainer nut retains each connector. Each nut has a hub that is threaded and is smaller in diameter than the sub hub.

A coiled inner spring threadingly engages each nut hub. A coiled outer spring surrounds and threadingly engages each sub hub. The outer spring surrounds the inner spring and is wound in an opposite direction of the inner spring. The springs are embedded within an elastomeric member.

The inner spring is dimensioned such that, for a selected lateral bend prior to installation with the outer spring, the inner spring will twist a selected angle in a first twist direction. Similarly, the outer spring is dimensioned such that for the selected lateral bend, prior to installation with the inner spring, the outer spring will twist substantially the same as the selected angle, but in a direction opposite to the first twist direction so as to cancel any twist between the subs once installed and subjected to a lateral bend. When the tool encounters a curved portion of the well, the inner spring, outer spring and elastomeric member flex to improve the navigability of the tool through the curved portion.

BEST MODE FOR CARRYING OUT THE INVENTION

Figure 1:
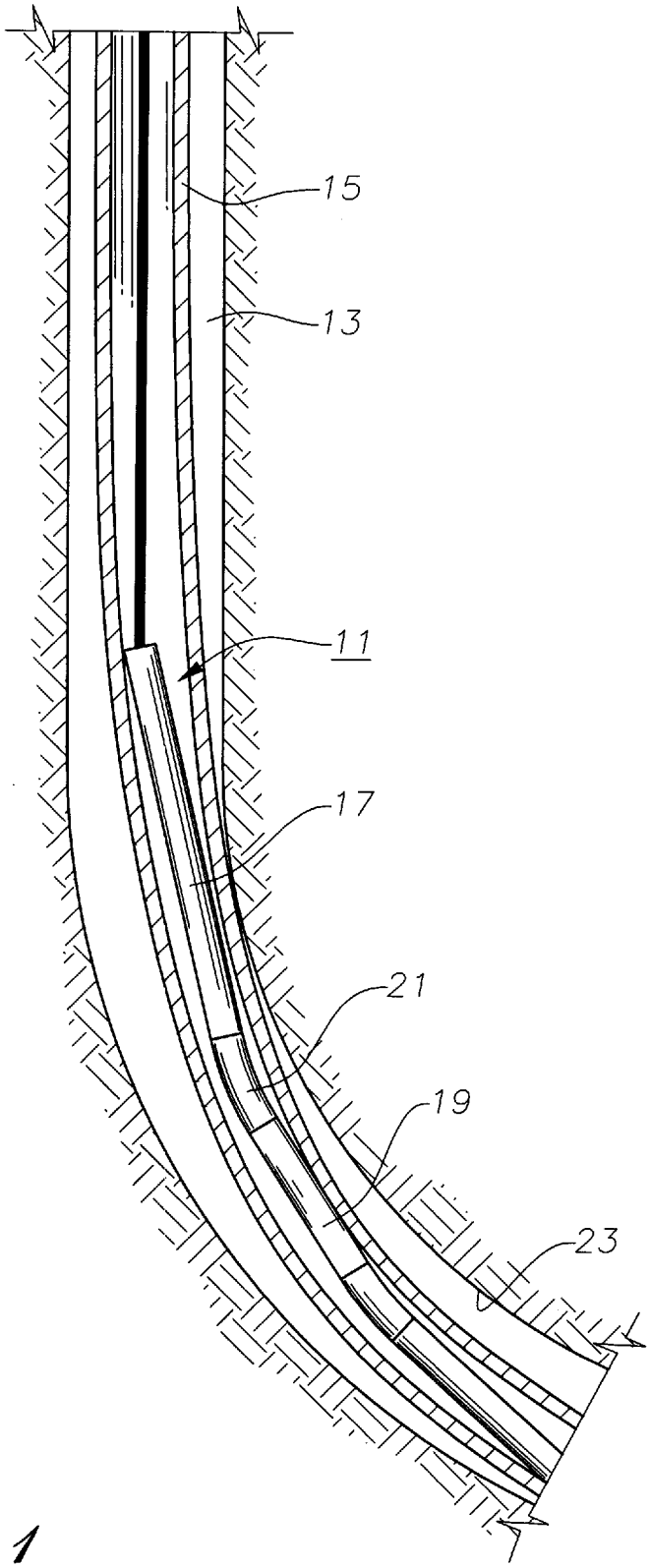
FIG. 1 is a schematic view of a well with a curved portion and a downhole tool with flexible joints that are constructed in accordance with the invention.

Referring to FIG. 1, a downhole measurement tool 11 for use in a well 13 is shown. A battery powered tool 11 is lowered into well 13 through the inner diameter of a drill pipe 15. Power is optionally supplied to tool 11 through an electrical conductor which extends downward from the surface. Tool 11 comprises two or more measurement modules 17, 19 which are joined together with a flexible joint or linkage 21. Linkage 21 is provided to enable tool 11 to bend or flex a limited amount between modules 17, 19 when a curved portion 23 of well 13 is encountered.

Figure 2:
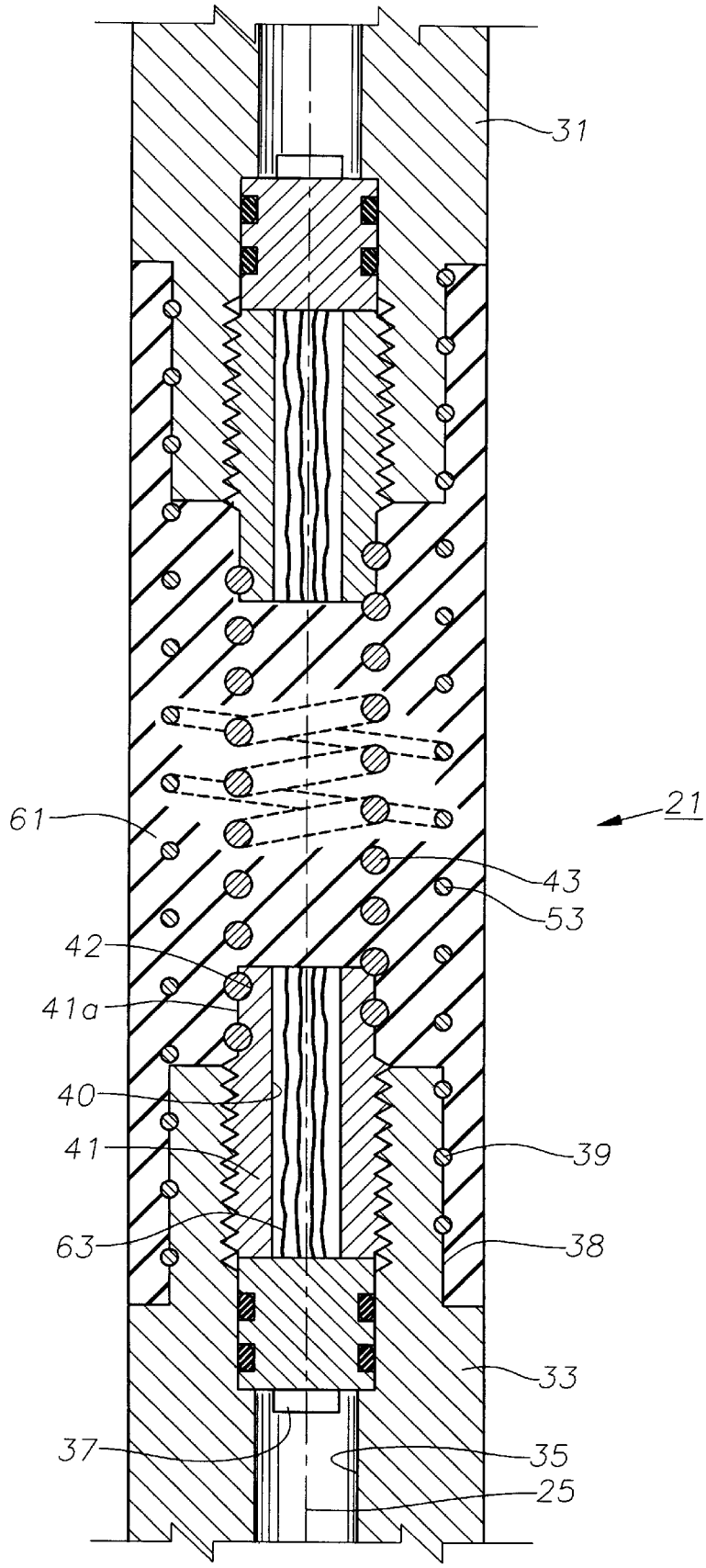
FIG. 2 is a sectional view of the flexible joint of FIG. 1.

Referring to FIG. 2, linkage 21 has an axis 25, a top sub 31 and a bottom sub 33. Each sub 31, 33 has a central bore 35 for receiving an electrical connection portion of modules 17, 19, respectively. A feed-through connector 37 is located within each bore 35 for electrical connection to modules 17, 19, which are coaxial. Each sub 31, 33 has an inward protruding cylindrical hub 38 of reduced diameter. Each hub 38 has a thread 39. A threaded retainer nut 41 having a bore 40 retains each connector 37. Each II nut 41 has an inward protruding cylindrical hub 41*a*. Each hub 41*a* has a helical thread 42 and is smaller in diameter than hub 38.

A coiled wire inner spring 43 threadingly engages threads 42 of each hub 41*a*. Inner spring 43 is wound in one direction, such as a right hand direction. A coiled wire outer spring 53 surrounds and threadingly engages threads 39 of hub 38. Outer spring 53 surrounds inner spring 43 and is wound in an opposite direction of inner spring 43 such as a left hand direction. Outer spring 53 has a spring constant which is greater than a spring constant of inner spring 43. Outer spring 53 also has a cross-sectional wire diameter that is less than a cross-sectional wire diameter of inner spring 43. In addition, the pitch and length of inner spring 43 are shorter than those of outer spring 53.

Springs 43, 53 are embedded within a generally cylindrical elastomeric member 61. In the preferred embodiment, member 61 is composed of viton. Member 61 may be bonded to hubs 38, 41*a*. A plurality of insulated electrical wires 63 extend between connectors 37 through bores 40, holes in member 61 and the center of inner spring 43.

Inner spring 43 is dimensioned such that, for a selected lateral bend prior to installation with outer spring 53, inner spring 43 will twist a selected angle in a first twist direction. Similarly, outer spring 53 is dimensioned such that for the selected lateral bend, prior to installation with inner spring 43, outer spring 53 will twist substantially the same as the selected angle, but in a direction opposite to the first twist direction so as to cancel any twist between subs 31, 33 once installed and subjected to a lateral bend.

In operation, flexible linkage 21 is secured to modules 17, 19 to form tool 11 which is lowered into well 13. When tool 11 encounters a curved portion 23, inner spring 43, outer spring 53 and member 61 flex to improve the navigability of tool 11 through curved portion 23. Inner spring 43 is dimensioned such that for a selected lateral bend it will twist a selected angle in a twist direction. Similarly, outer spring 53 is dimensioned such that for the same selected lateral bend, outer spring 53 will twist for the selected angle in an opposite direction to the twist direction. These equal and opposite reactions by springs 43, 53 cancel each other so that linkage 21 will not unnecessarily twist and will only bend in the direction of the selected lateral bend. In the preferred embodiment, linkage 21 will allow a typical tool to pass through drill pipe which has up to three degrees of bend for every foot of travel without causing mechanical damage to the tool.

The invention has several advantages. The flexible linkage allows higher bending rates between separate modules of downhole measurement systems without mechanical damage. The flexible joint will bend up to a selected amount with lower forces than prior art assemblies. With this flexible joint the modules may pass through curved portions of the well with moderately high rates of bend without mechanical damage. Finally, the invention has no moving parts which must be exposed to the corrosive downhole environment.

While the invention has been shown in only one of its forms, it should be apparent to those skilled in the art that it is not so limited, but is susceptible to various changes without departing from the scope of the invention.

I claim:

1. A flexible joint for joining a pair of downhole tool modules, the flexible joint comprising:

a pair of subs wherein each sub is adapted to connect to one of the modules;

a coiled inner spring connected between the subs, the inner spring being wound in a first direction; and a coiled outer spring surrounding the inner spring, connected between the subs, and being wound in a direction opposite to the first direction.

2. The flexible joint of claim 1 wherein the inner spring is dimensioned such that, for a selected lateral bend prior to installation with the outer spring, the inner spring will twist a selected angle in a first twist direction; and wherein the outer spring is dimensioned such that for the selected lateral bend, prior to installation with the inner spring, the outer spring will twist substantially the same as the selected angle, but in a direction opposite to the first twist direction so as to cancel any twist between the subs once installed and subjected to a lateral bend.

3.The flexible joint of claim 1 wherein the outer spring has a spring constant which is greater than a spring constant of the inner spring.

4. The flexible joint of claim 1 wherein the inner spring has a cross-sectional wire diameter that is greater than a cross-sectional wire diameter of the outer spring.

5. The flexible joint of claim 1 wherein each of the springs threadingly engages one of the subs.

6. The flexible joint of claim 1 wherein each of the subs has a cylindrical outer hub and a cylindrical inner hub of lesser diameter than the cylindrical outer hub, each of the hubs having threads on an outer portion; and wherein the inner spring threadingly engages the inner hub of each of the subs; and wherein the outer spring threadingly engages the outer hub of each of the subs.

7. The flexible joint of claim 1, further comprising an elastomeric body within which the springs are embedded.

8. The flexible joint of claim 1, further comprising an electrical connector located in each of the subs and at least one wire extending between the electrical connectors in the subs for electrically connecting the pair of modules to each other.

9. The flexible joint of claim 1, further comprising:

an elastomeric body within which the springs are embedded;

an electrical connector located in each of the subs and at least one wire extending between the electrical connectors in the subs for electrically connecting the pair of modules to each other.

10. A flexible joint for joining a pair of modules, comprising:

a pair of subs wherein each sub is adapted to connect to one of the modules;

a coiled inner spring connected between the subs, the inner spring being wound in a first direction;

a coiled outer spring surrounding the inner spring and connected between the subs and being wound in a direction opposite to the first direction, the outer spring having a spring constant which is greater than a spring constant of the inner spring, and the outer spring having a cross-sectional wire diameter that is less than a cross-sectional wire diameter of the inner spring; and an elastomeric body located between the subs in which the springs are embedded.

11. The flexible joint of claim 10 wherein the inner spring is dimensioned such that, for a selected lateral bend prior to installation with the outer spring, the inner spring will twist a selected angle in a first twist direction; and wherein the outer spring is dimensioned such that for the selected lateral bend, prior to installation with the inner spring, the outer spring will twist substantially the same as the selected angle, but in a direction opposite to the first twist direction so as to cancel any twist between the subs once installed and subjected to a lateral bend.

12. The flexible joint of claim 10 wherein each of the springs threadingly engages one of the subs.

13. The flexible joint of claim 10 wherein each of the subs has a cylindrical outer hub and a cylindrical inner hub of lesser diameter than the cylindrical outer hub, each of the hubs having threads on an outer portion; and wherein the inner spring threadingly engages the inner hub of each of the subs; and wherein the outer spring threadingly engages the outer hub of each of the subs.

14. The flexible joint of claim 10, further comprising an electrical connector located in each of the subs and at least one wire extending between the electrical connectors in the subs for electrically connecting the pair of modules to each other.

15. A flexible joint for joining a pair of modules which are lowered through well conduit, the flexible joint comprising:

a pair of subs wherein each sub is adapted to connect to one of the modules;

a cylindrical outer hub on each of the subs;

a cylindrical inner hub of lesser diameter than the outer hub, each of the hubs having threads on an outer portion;

coiled inner spring connected to the inner hubs, the inner spring being wound in a first direction;

a coiled outer spring surrounding the inner spring and connected to the outer hubs and being wound in a direction opposite to the first direction, the outer spring having a spring constant which is greater than a spring constant of the inner spring, and the outer spring having a cross-sectional wire diameter that is less than a cross-sectional wire diameter of the inner spring;

an elastomeric member located between the subs in which the springs are embedded;

an electrical connector in each of the subs;

a plurality of electrical wires between the electrical connectors and extending through the elastomeric member; and wherein the inner spring is dimensioned such that, for a selected lateral bend prior to installation with the outer spring, the inner spring will twist a selected angle in a first twist direction; and wherein the outer spring is dimensioned such that for the selected lateral bend, prior to installation with the inner spring, the outer spring will twist substantially the same as the selected angle, but in a direction opposite to the first twist direction so as to cancel any twist between the subs once installed and subjected to a lateral bend.

* * * * *

UNITED STATES PATENT AND TRADEMARK OFFICE

CERTIFICATE OF CORRECTION

PATENT NO. : 5,836,388
DATED : November 17, 1998
INVENTOR(S) : *Tchakarov*

It is certified that error appears in the above-identified patent and that said Letters Patent is hereby corrected as shown below:

In col. 2, line 16, please delete "II" following "Each".

In col. 4, line 40, Claim 15, please add --a-- before "coiled".

Signed and Sealed this

Second Day of March, 1999

*Attest:*

Q. TODD DICKINSON

*Attesting Officer*

*Acting Commissioner of Patents and Trademarks*